United States Patent [19]

Jütte et al.

[11] 4,012,916

[45] Mar. 22, 1977

[54] APPARATUS FOR CONSTRUCTING UNDERGROUND TUNNELS

[75] Inventors: Hans Jütte, Dortmund Brechten; Adolf Foik, Munich; Siegmund H. F. L. M. Babendererde, Bad Vilbel; Reinhard E. J. Bokemeyer, Offenbach, all of Germany

[73] Assignees: Gewerkschaft Eisenhutte Westfalia, Wethmar near Lunen; Hochtief AG, Frankfurt, both of Germany

[22] Filed: Dec. 10, 1975

[21] Appl. No.: 639,518

[30] Foreign Application Priority Data

Dec. 23, 1974 Germany ..... 2461241

[52] U.S. Cl. ..... 61/85; 61/42; 61/84

[51] Int. Cl.[2] ..... E01G 3/02

[58] Field of Search ..... 61/84, 85, 42; 299/31, 299/33, 55, 56, 60

[56] References Cited

UNITED STATES PATENTS

| | | | |
|---|---|---|---|
| 748,809 | 1/1904 | Stone | 61/85 |
| 3,379,024 | 4/1968 | Wohlmeyer | 61/85 |
| 3,411,826 | 11/1968 | Wallers et al. | 61/85 X |
| 3,581,507 | 6/1971 | Stevens | 61/85 |
| 3,800,549 | 4/1974 | Lobbe | 61/42 X |

FOREIGN PATENTS OR APPLICATIONS

| | | | |
|---|---|---|---|
| 182,115 | 5/1955 | Austria | 61/85 |
| 164,838 | 3/1965 | U.S.S.R. | 61/85 |

*Primary Examiner*—Dennis L. Taylor
*Attorney, Agent, or Firm*—Sughrue, Rothwell, Mion, Zinn & Macpeak

[57] ABSTRACT

Tunnel-driving apparatus has a drive shield which can be composed of a series of planks arranged side-by-side around the tunnel and supported by a frame. The drive shield is advanced to penetrate the working face by operating hydraulic rams. To control and guide the shield and to inhibit rotary motion thereof a drifting cutter is positioned radially externally of the drive shield to cut a channel in the wall and preferably in the floor of the tunnel. In the latter case the channel can also be useful for drainage purposes. The drifting cutter is of elongate form guided for shifting parallel to the tunnel axis in advance of the drive shield. The axis of the cutter can be adjusted slightly by pivoting, for example, to control the guidance imparted by the drifting cutter.

3 Claims, 2 Drawing Figures

APPARATUS FOR CONSTRUCTING UNDERGROUND TUNNELS

BACKGROUND TO THE INVENTION

The present invention relates to apparatus for constructing a tunnel, gallery or the like hereinafter collectively referred to as a tunnel.

Various forms of apparatus are known for constructing tunnels underground. One form of apparatus, with which the present invention is mainly concerned, employs a drive or cutting shield composed of elongate members or planks supported in side-by-side relationship around the tunnel so as to contact the wall thereof at least over the roof and side zones. These members are mounted on a rigid frame and are moved, usually by hydraulic rams, to attack a working face. As the tunnel driving progresses the frame is moved up to follow the advanced members. In other constructions the drive shield is in the form of a continuous cylinder advanced by rams rather than separate members.

A major problem frequently encountered with the generally known form of apparatus is that the control or guidance of the drive shield is difficult and there is a tendency for the shield to rotate about its axis. Another problem also encountered is that efficient drainage of water is sometimes difficult to achieve without recourse to pumping equipment which is undesirable in the cramped conditions prevailing.

With regard to the foregoing, a general object of the invention is to provide an improved apparatus for constructing a tunnel.

BRIEF SUMMARY OF THE INVENTION

In its broadest aspect the present invention provides an apparatus for constructing an underground tunnel; said apparatus comprising a drive shield, means for advancing the drive shield to effect driving of the tunnel and a drifting cutter positioned radially outwards from the drive shield and serving to cut a channel in the tunnel wall.

The knife or drive shield is composed of a plurality of elongate members arranged side-by-side in parallel configuration and generally around the axis of the tunnel, a frame for supporting and guiding the members for longitudinal displacement, and means for advancing the drive shield cause relative displacement between the frame and the elongate members.

A platform can be disposed in the frame to support means for detaching and conveying material from a working face at the front of the drive shield.

The drifting cutter is movable with the drive shield and is disposed to cut the channel in the floor of the tunnel.

There is also provided means for guiding the drifting cutter for longitudinal displacement and means for displacing the drifting cutter longitudinally whereby the cutter may be advanced forwardly of the shield.

Means are also provided to adjust the position of the drifting cutter by angularly swinging its longitudinal axis in relation to the longitudinal tunnel axis.

In general the drifting cutter provides guidance of the drive shield and inhibits rotary movement of the drive shield. Moreover, where the drifting cutter is located at the floor region the channel thus created in the floor can serve to drain water while the inter-engagement between the cutter and the channel achieves the necessary guidance. The adjustability of the longitudinal axis of the drifting cutter through a small angle provides some control of the driving operation.

Although it is probably more convenient for the apparatus to have a single continuous drifting cutter it is feasible to utilize a plurality of such cutters.

The invention may be understood more readily, and various other features of the invention may become more apparent, from consideration of the following description.

BRIEF DESCRIPTION OF DRAWING

An embodiment of the invention will now be described, by way of examples only, with reference to the accompanying drawings, wherein.

DESCRIPTION OF PREFERRED EMBODIMENT

Figure 1:
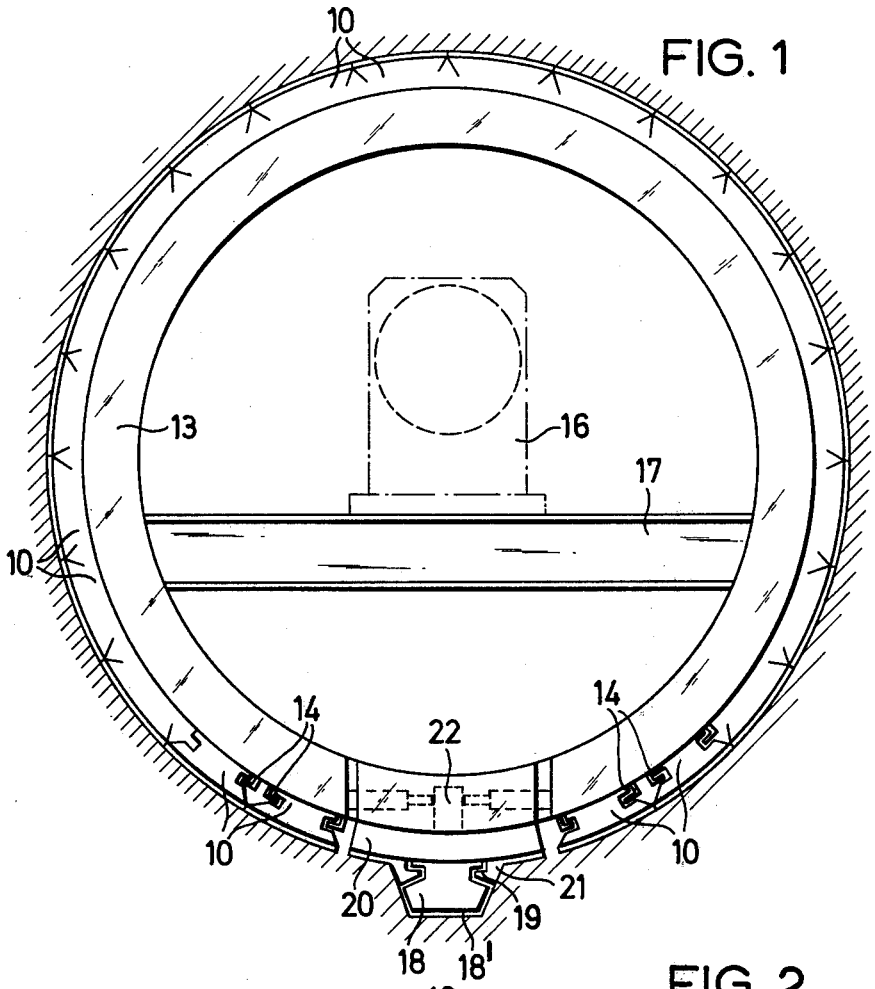
FIG. 1 is a schematic cross-sectional view of an apparatus made in accordance with the invention.

As shown in the drawing the apparatus employs a drive or cutting shield composed of a series of elongate members 10 arranged side-by-side in parallel configuration around the axis of a tunnel. These members 10 are only partially represented for convenience in FIG. 1. The members 10 are supported and guided by means of a frame 13 which may take the form of two axially spaced interconnected annular components. The members 10 have cutting edges 15 at their forward ends designed to attack and penetrate a working face at the front end of the tunnel when the members 10 are urged forwardly by means of double-acting hydraulic rams 11. Each ram 11 may serve to shift a single member 10 or a group of members 10. Each ram 11 has its piston rod pivotably connected as at 12 to the inside of an associated member 10 and its cylinder is connected to the frame 13. Extension of any one ram 11 will shift the member 10 or members 10 operably connected thereto parallel to the axis of the tunnel. During the driving of the tunnel, the rams 11 are extended one after another to advance the individual members or groups of members 10 and the frame 13 and the stationary members 10, which are in frictional contact with the tunnel wall, act as an abutment for the ram 11 which is extended. When all the rams 11 have been extended in this way, all the members 10, and hence the entire drive shield, are fully advanced and thereafter the rams 11 are operated in unison to retract and draw up the frame 13 towards the advanced shield. Here all the members 10 collectively act as an effective abutment for the rams 11 by virtue of their frictional contact with the surrounding tunnel wall. At this stage, or prior to the shifting of the frame 13, the material at the working face within the tunnel wall defined by the members 10 can be detached and conveyed away ready for the next shifting sequence commencing with the successive advancement of the members 10.

To positively guide the members 10 in relation to the frame 13 the sides of the members 10 have grooves 14 which receive L-shaped tongues provided on the frame 13. These tongue-and-groove connections permit longitudinal displacement of the members 10 and restrain lateral and radial movements of the members 10.

The apparatus has a horizontal platform 17 secured inside the frame 13 and supporting a device 16 represented in chain-dotted outline which serves to detach and convey away debris material from the working face of the tunnel inside the cutting edges of the members 10.

Figure 2:
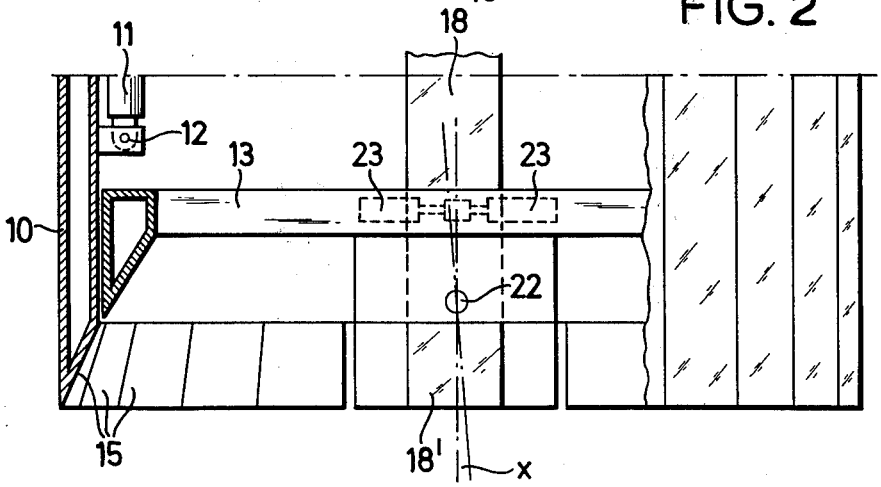
FIG. 2 is a part-sectional cut-away plan view of a floor part of the apparatus shown in FIG. 1.

As shown in FIG. 1, a special guide 20 is provided at the floor region of the frame 13. This guide 20 is provided with tongues or projections 19 which engage in grooves at the sides of a drifting cutter 18. This cutter 18 is of elongate form and is adapted to slide longitudinally in relation to the guide 20 with the tongue-and-groove connections providing guidance. To displace the cutter 18 longitudinally there is provided an hydraulic ram (not shown) connected to the frame 13. The cutter 18 is disposed radially outwards of the drive shield, i.e., of the members 10. The cutter 18 has a cutting profile 18' designed to cut a channel 21 in the floor of the tunnel. Besides its longitudinal displaceability the cutter 18 can also be adjusted to a limited extent so that its longitudinal axis can swing through a small angle (shown as X in FIG. 2) about a vertical pivot axis. To this end, the guide 20 can be pivotably carried on a pivot pin 22 provided on the frame 13. Alternatively, a pin can be provided on the cutter 18 so as to engage in an elongate slot in the guide 20 or a component of the frame 13. Means is provided to adjust the position of the cutter 18 in this respect. In the illustrated construction, this means is constituted by a pair of piston and cylinder units 23 operably connected between the guide 20 and the frame 13. Other forms of adjustment means can also be used instead of these units 23, for example, the adjustment means may be in the form of a threaded spindle or wedges or cams. The adjustment means, 23 or otherwise, is preferably provided at the rear of the frame 13 to produce the maximum turning force acting on the cutter 18.

During operation, the cutter 18 is advanced before the members 10 of the drive shield so as to create the channel 21 in advance of the working face and the drive shield. The cutter 18 and the channel 21 then inter-act as a guide means to stabilize and guide the shield as the individual members 10 are advanced. The cutter 18 and the channel 21 also prevent the drive shield from partly rotating about the axis of the tunnel. More particularly, the adjustment of the cutter 18 produces a helical guiding effect on the shield which acts in opposition to the tendency of the shield to perform a rotary movement, which usually arises, and serves to effectively "steer" the drive shield. The channel 21 moreover serves to drain off water.

In an alternative construction the drive shield of the apparatus can be of continuous cylindrical form, known per se, instead of the individual members 10. The function and operation of the drifting cutter 18 would be as described.

We claim:

1. In an underground tunneling apparatus of the type comprising a drive shield composed of a plurality of elongate members arranged side-by-side in a parallel configuration and generally around the axis of said tunnel, a frame for supporting and guiding said members for longitudinal displacement, a drifting floor cutter movable with the drive shield and operable to cut a channel in the floor in said tunnel, and means for causing relative displacement between said drive shield and said drifting floor cutter, the improvement comprising:

a guide provided on the frame and slidably contacting and guiding the floor cutter for movement in relation to the drive shield and parallel to the longitudinal axis of the tunnel;

pivoting means for defining a vertical pivot axis about which said floor cutter can be rotated; and rotating means for rotating said floor cutter about said vertical pivot axis to effect steering of said drive shield.

2. An apparatus according to claim 1, and further comprising a platform mounted within the frame and serving to support means for detaching and conveying debris material away from a working face at the front of the drive shield.

3. An apparatus according to claim 2, wherein the platform is horizontal or substantially horizontal and is supported by the frame in an elevated position in the vicinity of the longitudinal axis of the tunnel.

* * * * *